US005443878A

United States Patent [19]

Treloar et al.

[11] Patent Number: 5,443,878

[45] Date of Patent: Aug. 22, 1995

[54] COMPOSITE WEATHERBOARD

[75] Inventors: Kerry R. Treloar; Johannes La Grouw; Cornelius La Grouw, all of Rotorua, New Zealand

[73] Assignee: La Grouw Corporation Limited, Rotorua, New Zealand

[21] Appl. No.: 278,037

[22] Filed: Jul. 20, 1994

[51] Int. Cl.[6] ..... E04D 13/00

[52] U.S. Cl. ..... 428/60; 428/58; 428/99; 428/100; 52/519; 52/533; 52/534; 52/540; 52/539

[58] Field of Search ..... 428/60, 58, 99, 100; 52/313, 540, 535, 556, 519, 525, 533, 534, 539

*Primary Examiner*—Alexander S. Thomas

*Attorney, Agent, or Firm*—Jacobson, Price, Holman & Stern

[57] ABSTRACT

A composite weatherboard having a timber member and a metal exterior sheath. The sheath is extruded with longitudinal projections which are fitted and pressed into permanent engagement with corresponding grooves or tongues provided in the timber member thereby obviating the need to use an adhesive or other fastener.

7 Claims, 5 Drawing Sheets

COMPOSITE WEATHERBOARD

FIELD OF INVENTION

This invention relates to a composite weatherboard or siding for use in the construction of domestic and light commercial buildings and in particular to a weatherboard having an exterior metal sheath. The weatherboard is factory assembled ready for fixing on site.

PRIOR ART

Metal weatherboards to be used in place of wooden weatherboards are well known. They generally have an exterior profile similar to the wooden weatherboards which they are intended to simulate. They have no inherent thermal insulation properties and their inner surfaces are unsuitable as an interior wall in domestic dwellings.

It is also known for planks used in the construction of solid wood wall houses to be factory-made with a thin aluminum sheet on the exterior surface to provide a low maintenance exterior. In this system the thin aluminum sheath is attached to the wooden plank by a chemical adhesive. Problems may be encountered with such a composite planks where adhesives used do not possess long term stability.

SUMMARY OF THE INVENTION

It is an object of the present invention to provide a composite weatherboard which goes some way towards overcoming the abovementioned disadvantages of the prior art systems.

Accordingly, the invention consists in a prefinished composite weatherboard comprising a wooden plank having top and bottom edges machined to allow mating engagement with the opposite edge of the planks of identically formed weatherboards and a metal sheathing fixed to the outer face of said plank to cover the exposed surface of the weatherboard in use. The sheathing is at least in part secured to the plank by fixing means attached to the inner surface of the sheathing which frictionally engage within a longitudinal notch provided in the outer face of the plank.

BRIEF DESCRIPTION OF THE DRAWINGS

All drawings show cross-sectional views only of weatherboards and all weatherboards shown are of constant cross-section.

DETAILED DESCRIPTION OF THE PREFERRED EMBODIMENTS OF THE INVENTION

The present invention provides a metal sheathing member which may be applied to the exterior surface of timber planks to form a composite weatherboard having a low maintenance exterior. The sheathing is preferably aluminium and is formed by extrusion. The sheathing so formed is fixed to the timber plank without the use of adhesives or other traditional fasteners.

Figure 1:
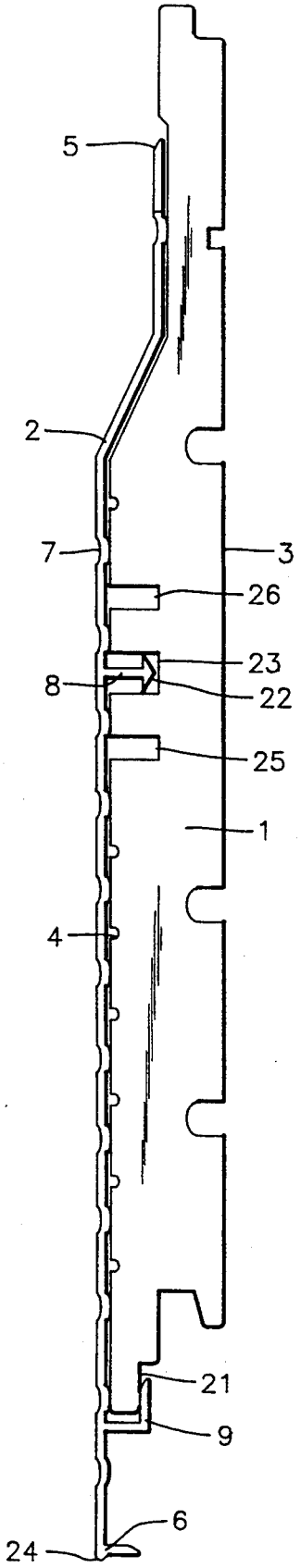
FIG. 1 shows a weatherboard having a first profile and a first form of sheathing fixing means.
Figure 3:
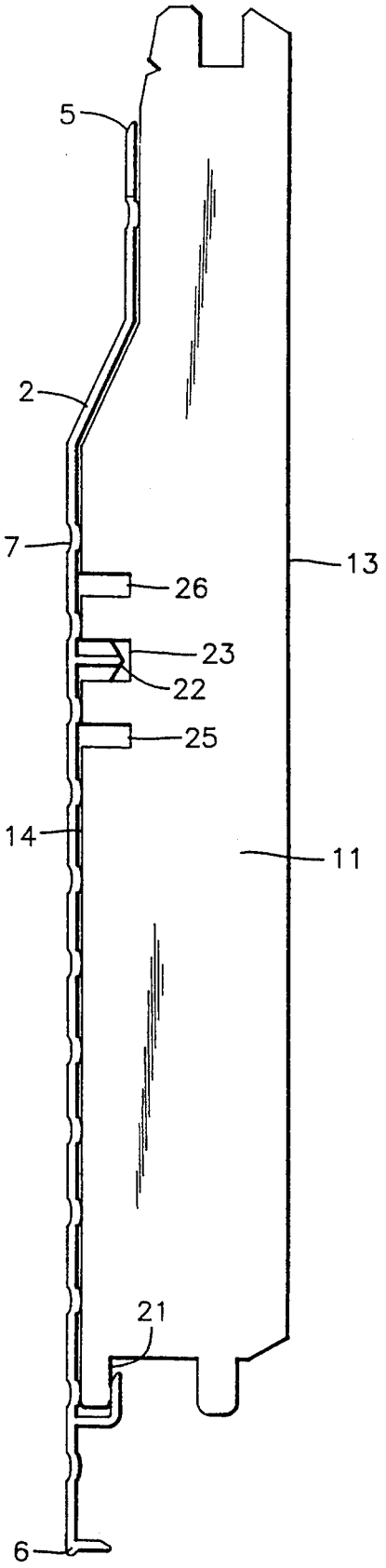
FIG. 3 shows a weatherboard having a second profile with the first form of sheathing fixing means.
Figure 6:
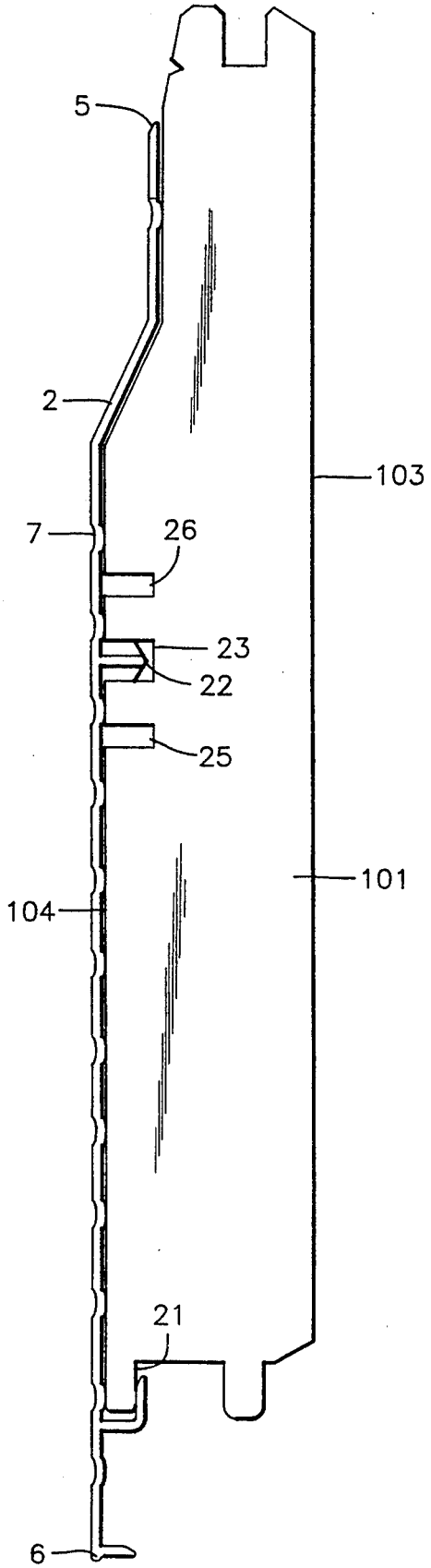
FIG. 6 shows a weatherboard having a third profile with the first form of sheathing fixing means.

The shape of the timber plank to which the sheathing is applied may take a number of forms, three forms are shown in the accompanying drawings—see FIGS. 1, 3 and 6, for example, plank 1 in FIG. 1 is profiled in the manner of a traditional rusticated weatherboard. The composite weatherboard (19 mm thick) produced by the fixing of sheathing 2 to plank 1 would be used in applications where the inner surface of the weatherboard would not be intended to be visible after erection. Planks 10 and 101 in FIGS. 3 and 6 could be used where it was desired that the inner surfaces 13 and 103 were intended to be the interior surface of the building and visible to occupants, either with framing members being revealed or as a frameless solid wall. Typical thicknesses for these latter forms of weatherboard are 32 mm and 40 mm.

Referring to FIGS. 1, 3 and 6, it will be noted that the cross-section of sheathing 2 is identical. The principal contours of the sheathing follows that of the outer surfaces 4, 14 and 104 of planks 1, 11 and 101. However the top edge 5 of sheathing 2 finishes short of the top edge of the planks while the bottom edge of the sheathing edge extends below the bottom edge of the planks.

Sheathing 2 is provided with a number of parallel longitudinal indentations 7 which provide a decorative effect and also allow for horizontal movement of rainwater. The extrusion is preferably less than 2 mm thickness. The exterior surface of sheathing 2 is provided with a protective coating of paint during fabrication of the weatherboard which also improves the aesthetic appearance of the weatherboard.

Sheathing 2 is fixed to planks 1, 11 and 101 by the provision of a longitudinal fin 8 extending from the inner surface of the sheathing and a longitudinal "L" or channel piece 9 extending from near the lower edge of the inner surface of the sheathing. Elements 8 and 9 co-operate with formations in the planks to facilitate fixing of the sheathing to the planks. A tongue 21 is provided in the bottom edge of planks 1, 11 and 101 to match the internal width of channel section 9 of the sheathing. The sheathing 2 can be slid over the planks to engage tongue 21 within channel section 9 to thereby secure the lower edge of the sheathing of the plank.

Fin section 8 is provided with a tapered flange 22 (which forms an arrow head in cross-section) and a corresponding notch 23 is provided in the outer surface of the planks. The width of notch 23 is slightly less than the width of flange 22 so that force must be applied to engage flange 22 within notch 23 to assume the disposition illustrated in the drawings. The reaction forces of the timber exerted by the notch walls fixes flange 22 in the position shown.

The two point fixing described is sufficient to hold the sheathing 2 in permanent contact with the planks.

Figure 9:
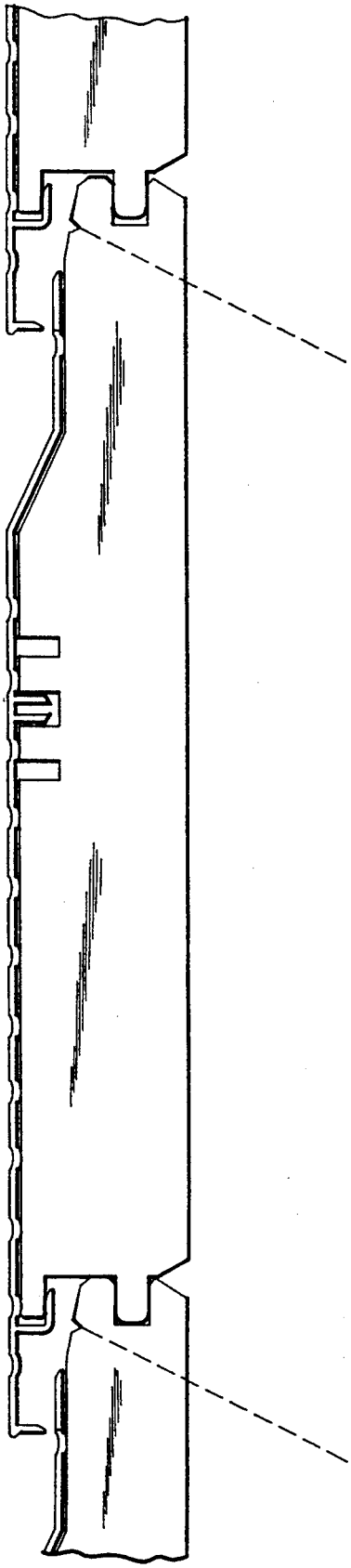
FIG. 9 shows the weatherboard of FIG. 4 erected in a building wall interlocked with adjacent weatherboards.
Figure 10:
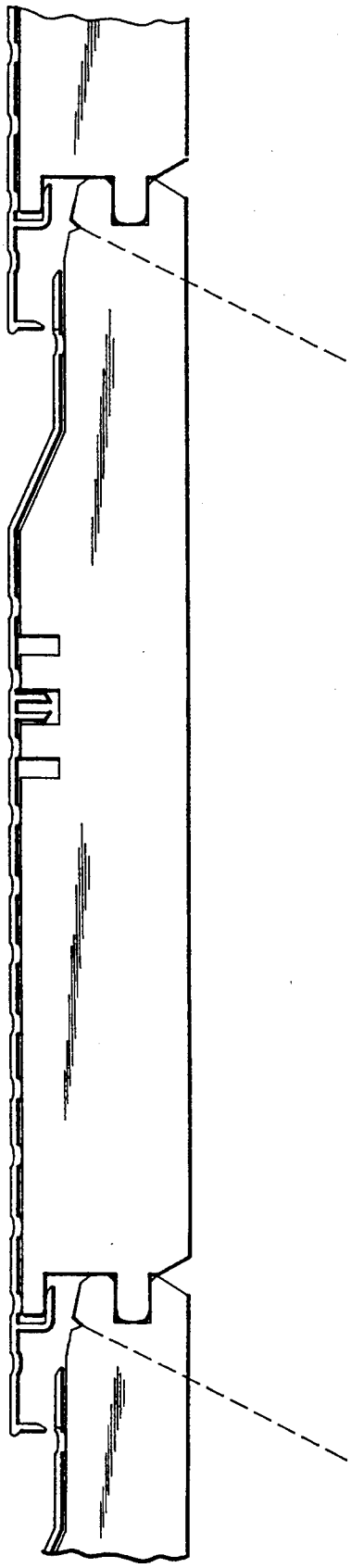
FIG. 10 shows the weatherboard of FIG. 7 erected in a building wall interlocked with adjacent weatherboards.

The extended lower edge 6 of the extruded sheathing forms a rain shield, the function of which is apparent from FIGS. 9 and 10 where it is shown overlapping the top edge of the weatherboard located adjacent and below. A bead or protuberance 24 is formed in the outer region of lower edge 6 of sheathing 2 to promote run off of rain water moving down the surface of the sheathing.

Secondary notches 25 and 26 may be provided either side of notch 23, particularly in high density timber to allow flange 22 to be pressed into notch 23 to its full depth without undue press force being required. The presence of notches 25 and 26 increase slightly the elasticity of the timber forming the side walls of notch 23. They also reduce any tendency of the plank to split as a result of the forces exerted on the timber by the fixing fins.

Figure 2:
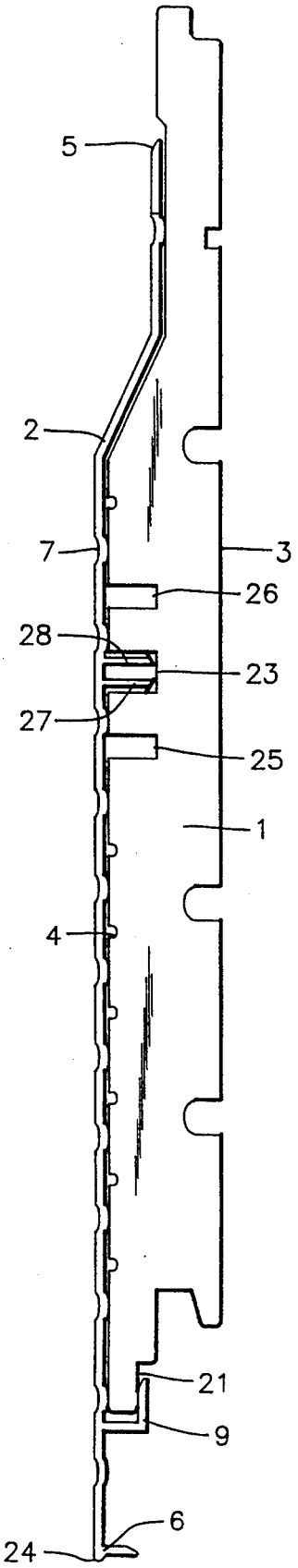
FIG. 2 shows a weatherboard having the first profile with a second form of sheathing fixing means.
Figure 4:
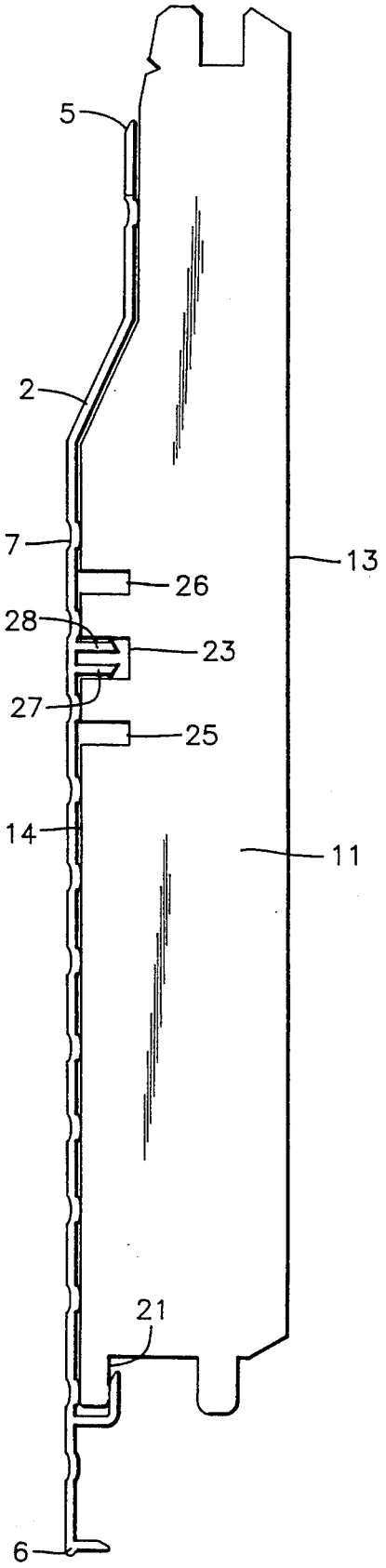
FIG. 4 shows a weatherboard having the second profile with the second form of sheathing fixing means.
Figure 7:
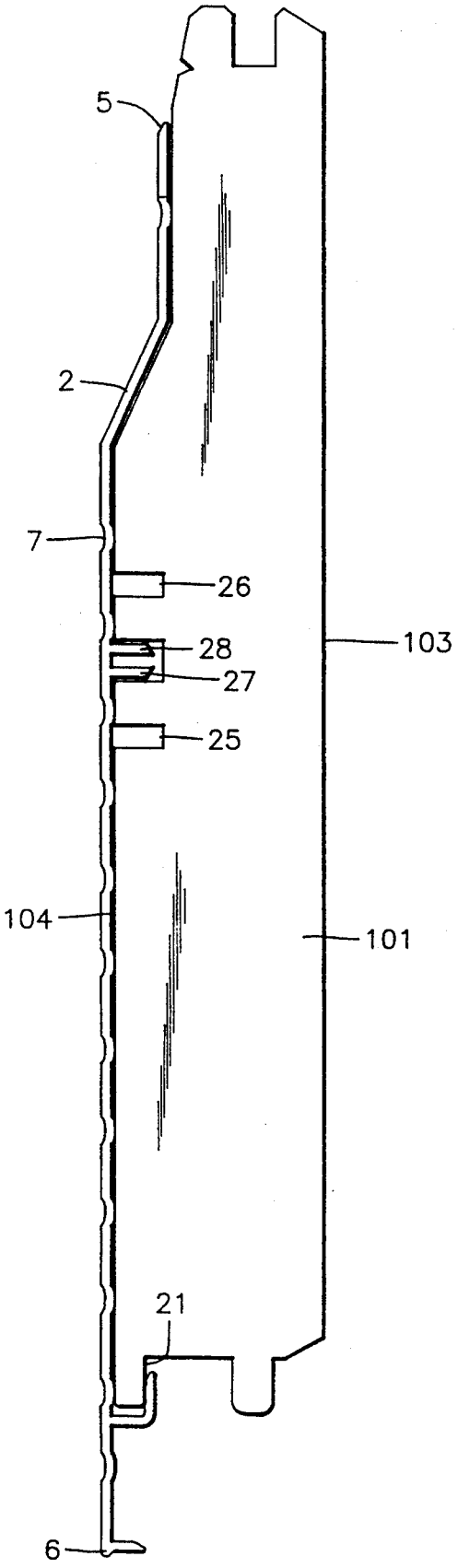
FIG. 7 shows a weatherboard having the third profile with the second form of sheathing fixing means.

FIGS. 2, 4 and 7 show a second form of sheathing where the upper fixing means is provided by two parallel longitudinal fins 27 and 28 having flanges located at their distal ends extending outwardly only. In cross-section these flanges appear as barbs. The width between the outer edges of opposing barbs is slightly greater than the width of notch 23, thus when fins 27 and 28 are pressed into notch 23 they are held in place due to the reaction force exerted by the side walls of the notch. However, in this case the elasticity of fins 27 and 28 allows for lateral deflection of the barbs during insertion, thereby reducing the press force required to fix the sheathing in place. Again, notches 25 and 26 may be provided either side of primary notch 23.

Figure 5:
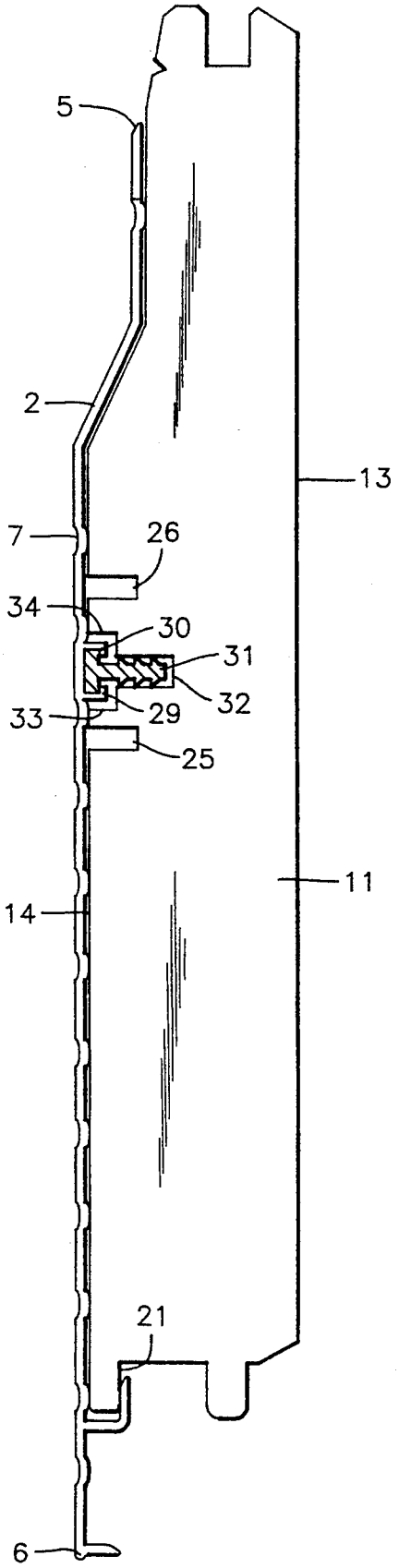
FIG. 5 shows a weatherboard having the second profile with a third form of sheathing fixing means.
Figure 8:
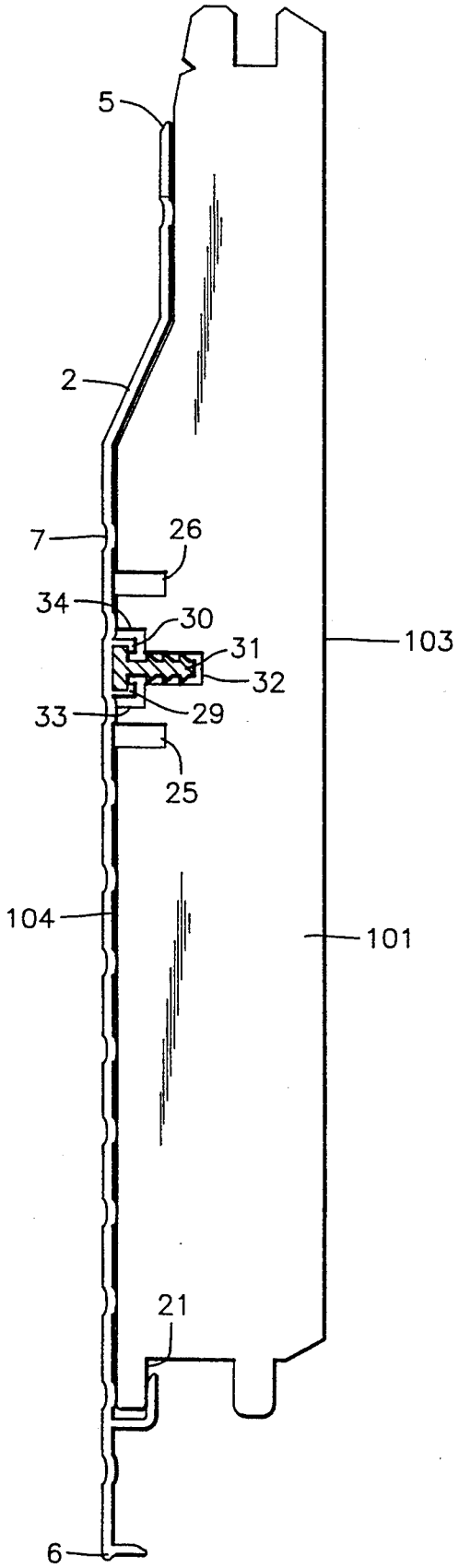
FIG. 8 shows a weatherboard having the third profile with the tgird form of sheathing fixing means.

A third form of fixing means is shown in FIGS. 5 and 8. In this case instead of sheathing 2 being provided with a fin or fins for engagement within a notch in the plank a flanged channelled section is provided with side walls 29 and 30. The purpose of this channel is to retain an elongated member 31 which is in turn pressed into notch 32 provided in the outer surface of the plank. Notch 32 is deeper than corresponding notch 23 in the embodiments already described. In addition the mouth of notch 32 is provided with rebates 33 and 34 to accommodate channel walls 29 and 30.

Fixing member 31, which is preferably formed from a plastics material, is provided with a bottom flange for engagement within the channel section and compressible barbs on its upper and lower surfaces which in use engage with and induce reaction forces in the side walls of notches 32. This alternative fixing means has advantages with certain timer types and densities.

It will be appreciated from the above that the invention provides an aluminium sheathing for covering the exterior surface of a timber weatherboard with a simple means of fixing being provided which does not require the use of an adhesive or complex manufacturing steps.

We claim:

1. A prefinished composite weatherboard comprising a wooden plank having top and bottom edges machined to allow mating engagement with the opposite edge of the planks of identically formed weatherboards and a metal sheathing fixed to the outer face of said plank to cover the exposed surface of the weatherboard in use, said sheathing being at least in part secured to said plank by fixing means attached to the inner surface of said sheathing which frictionally engage within a longitudinal notch provided in the outer face of said plank.

2. A weatherboard according to claim 1 wherein said fixing means comprises a longitudinal fin projecting from the inner surface of said sheathing, the distal edge of said fin having a symmetrical tapered flange which in use engages under compression with opposite side walls of said notch.

3. A weatherboard according to claim 1 wherein said fixing means comprises two parallel longitudinal fins projecting from the inner surface of said sheathing, the distal edges of said fins each having an asymmetric tapered flange which in use each engage under a lateral reaction force with a respective opposite side wall of said notch.

4. A weatherboard according to claim 1 wherein said fixing means comprise a longitudinal flanged channel projecting from the inner surface of said sheathing and a non metallic fin member retained within said channel and extending therefrom having surface protuberances which in use engage under compression with opposite side walls of said notch.

5. A weatherboard according to claim 1 wherein said sheathing includes a longitudinal L shaped fin extending from the inner surface thereof adjacent one edge, wherein said plank has a groove or rebate provided in a corresponding edge and said return fin engages in use within said groove or rebate.

6. A weatherboard according to claim 1 wherein said sheathing is an aluminium extrusion having said fixing means integrally formed in the inner surface thereof and wherein said extrusion has the outer surface thereof treated with a protective and decorative coating.

7. A weatherboard according to claim 1 wherein said plank is provided with a groove in an edge and a complementary tongue in the other edge to allow the opposite edges of planks of identically formed weatherboards to matingly engage.

* * * * *